US007412181B2

(12) United States Patent
Mulder et al.

(10) Patent No.: US 7,412,181 B2
(45) Date of Patent: Aug. 12, 2008

(54) MULTIVARIATE PREDICTIVE CONTROL OF FUSER TEMPERATURES

(75) Inventors: Pieter Mulder, Welwyn Garden (GB); Martin Callis, Hemel Hempstead (GB); John Poxon, Stevenage (GB); Riley Brede, Welwyn Garden (GB); Ian Pitts, Cambs (GB); Nicholas Baxter, Welwyn Garden (GB)

(73) Assignee: Xerox Corporation, Norwalk, CT (US)

( * ) Notice: Subject to any disclaimer, the term of this patent is extended or adjusted under 35 U.S.C. 154(b) by 315 days.

(21) Appl. No.: 11/314,847

(22) Filed: Dec. 21, 2005

(65) Prior Publication Data

US 2007/0140718 A1 Jun. 21, 2007

(51) Int. Cl.
*G03G 15/20* (2006.01)

(52) U.S. Cl. ..... 399/69; 399/328

(58) Field of Classification Search ..... 399/67, 399/69, 88, 328, 329, 330; 219/216, 469, 219/470; 432/60

See application file for complete search history.

(56) References Cited

U.S. PATENT DOCUMENTS 3,831,553 A 8/1974 Thettu
4,853,741 A 8/1989 Ku
5,049,944 A 9/1991 DeBolt et al.
5,200,785 A 4/1993 Hoover et al.
6,490,423 B2 12/2002 Horobin et al.
6,532,353 B1 3/2003 Orchard et al.
6,876,832 B2 4/2005 Pirwitz et al.
6,901,226 B2 * 5/2005 Claassen ..... 399/67
7,027,749 B2 * 4/2006 Kamei ..... 399/69
7,130,555 B2 * 10/2006 Kishi et al. ..... 399/69
7,130,556 B2 * 10/2006 Kinouchi et al. ..... 399/69
7,164,870 B2 * 1/2007 Satoh ..... 399/69

OTHER PUBLICATIONS

U.S. Appl. No. 11/314,904, filed Dec. 21, 2005, Poxon et al.
U.S. Appl. No. 11/314,253, filed Dec. 21, 2005, Poxon et al.

* cited by examiner

*Primary Examiner*—Hoan H Tran
(74) *Attorney, Agent, or Firm*—Fay Sharpe LLP

(57) ABSTRACT

A fusing apparatus includes a fuser roll and a pressure roll which define a nip therebetween. Two heating elements heat the fuser roll. One of the heating elements is configured for heating a first portion of the fuser roll while a second of the heating elements is configured for heating a second portion of the fuser roll. The second portion of the fuser roll is axially spaced from the first portion. A temperature sensing system monitors a temperature of the fuser roll in a first location and monitors a temperature of the fuser roll in a second location which is axially spaced from the first location. A control system determines an amount of power to supply to the first heating element as a function of the monitored temperatures at the first and second axially spaced locations and determines an amount of power to supply to the second heating element as a function of the monitored temperatures at the first and second axially spaced locations.

21 Claims, 4 Drawing Sheets

MULTIVARIATE PREDICTIVE CONTROL OF FUSER TEMPERATURES

CROSS REFERENCE TO RELATED PATENTS AND APPLICATIONS

The following applications, the disclosures of which are expressly incorporated herein by reference in their entireties, are mentioned:

U.S. application Ser. No. 11/314,904, filed contemporaneously herewith, entitled "AXIALLY TRANSLATING WEB CLEANING SYSTEM FOR A FUSER," by John Poxon, et al.

U.S. application Ser. No. 11/314,253, filed contemporaneously herewith, entitled "REUSABLE WEB CLEANING SYSTEM FOR A FUSER," by John Poxon, et al.

BACKGROUND

The present exemplary embodiment relates to a fuser apparatus for an electrophotographic marking device and, more particularly, to control of an operating temperature of a fuser apparatus.

In typical xerographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a dry marking material. Generally, the marking material comprises pigmented toner particles adhering triboelectrically to carrier granules, which is often referred to simply as toner. The developed image is subsequently transferred to the print medium, such as a sheet of paper.

The fusing of the toner image onto paper is generally accomplished by applying heat and pressure. A typical fuser assembly includes a fuser roll and a pressure roll which define a nip therebetween. The side of the paper having the toner image typically faces the fuser roll, which is often supplied with a heat source, such as a resistance heater, such as a lamp, at the core thereof. The combination of heat from the fuser roll and pressure between the fuser roll and the pressure roll fuses the toner image to the paper, and once the fused toner cools, the image is permanently fixed to the paper.

The paper passing through the fuser absorbs heat from the fuser roll. The temperature of the roll is measured by a thermistor and power is supplied to the resistance heater to maintain the fuser roll at a desired operating temperature. When narrow width paper is fed to the fuser, the side of the fuser roll which does not make contact with the paper tends to heat preferentially. In some fuser assemblies, the heater includes two lamps aligned parallel with the fuser axis, which preferentially heat different sides of the fuser roll. Each lamp is associated with its own control loop with a thermistor for measuring the temperature of the respective side of the fuser roll and controlling the lamp to maintain the desired temperature. Each of the feedback loops operates independently, ignoring the influence of one lamp on the temperature of the other side of the fuser roll, and vice versa. It has been found that, particularly for long print jobs employing relatively narrow paper, the temperature of the side of the fuser roll which does not make contact with the paper can reach unacceptably high levels. If the temperature of the fuser roll becomes too high, the fuser roll, or associated equipment, such as a web cleaning device, can be damaged. Accordingly, the printer is often cycled into a non-operational mode for a period of time to allow the fuser roll to reach a safe operating temperature.

INCORPORATION BY REFERENCE

U.S. Pat. No. 6,490,423 by Horobin, et al., which is expressly incorporated herein by reference, in its entirety, discloses a method of operating a xerographic fusing apparatus with two heat lamps. When powering up the fusing apparatus, power is applied to each lamp in a stair-step fashion, in which incremental increases in applied power for each lamp are staggered in time.

BRIEF DESCRIPTION

Aspects of the exemplary embodiment relate to a fusing apparatus and to a method of fusing. In one aspect, a fusing apparatus includes a fuser roll and a pressure roll which define a nip therebetween. Two heating elements heat the fuser roll. A first of the heating elements is configured for heating a first portion of the fuser roll. A second of the heating elements is configured for heating a second portion of the fuser roll, the second portion being axially spaced from the first portion. A temperature sensing system monitors a first temperature of the first portion of the fuser roll and monitors a second temperature of the second portion of the fuser roll. A control system determines an amount of power to supply to the first heating element based on the first and second monitored temperatures and determines an amount of power to supply to the second heating element based on the first and second monitored temperatures.

In another aspect, a method includes providing a fuser roll and first and second heating elements. The method includes monitoring a temperature of a first portion of a fuser roll and monitoring a temperature of a second portion of the fuser roll which is axially spaced from the first portion. A first amount of power is supplied to the first heating element. The first amount of power is a function of the monitored temperatures of the first and second portions. The first heating element preferentially heats the first portion. A second amount of power is supplied to the second heating element. The second amount of power is a function of the monitored temperatures of the first and second portions. The second heating element preferentially heats the second portion.

In another aspect, a fusing apparatus includes a fuser roll. A first heating element heats a first portion of the fuser roll more than a second portion of the fuser roll. A second heating element heats the second portion of the fuser roll more than the first portion of the fuser roll. A first temperature sensor monitors a temperature of the first portion of the fuser roll. A second temperature sensor monitors a temperature of the second portion of the fuser roll. A control system determines a first amount of power to supply to the first heating element for heating the fuser roll, the first amount of power being a function of the monitored temperatures of the first and second portions, and determines a second amount of power to supply to the second heating element for heating the fuser roll, the second amount of power being a function of the monitored temperatures of the first and second portions.

In another aspect, a method of fusing print media of different widths includes monitoring a temperature of a first portion of a fuser roll which contacts a first print media having a first width during fusing of the first print media and contacts a second print media having a second width less than the first width during fusing of the second print media. The method further includes monitoring a temperature of a second portion of the fuser roll which contacts the first print media having the first width during fusing of the first print media but does not contact the second print media having the second width during fusing of the second print media. An amount of power to supply to a first heating element which heats the first portion and an amount of power to supply to a second heating element which heats the second portion is determined such that when the first portion contacts the print media having the second width, the amount of power supplied to the first heating element takes into account the monitored temperature of the second portion to inhibit the second portion from exceeding a preselected maximum operating temperature.

DETAILED DESCRIPTION

Aspects of the exemplary embodiment relate to a fusing assembly and to a method of fusing. In one aspect, the fusing assembly includes first and second heating elements configured for preferentially heating respective ends of a fuser roll. When narrow paper is to be fused, the fuser assembly takes into account temperature measurements from both ends of the fuser in determining power to apply to the heating elements so that the end of the fuser which is not in contact with the narrow paper does not overheat unduly.

Figure 1:
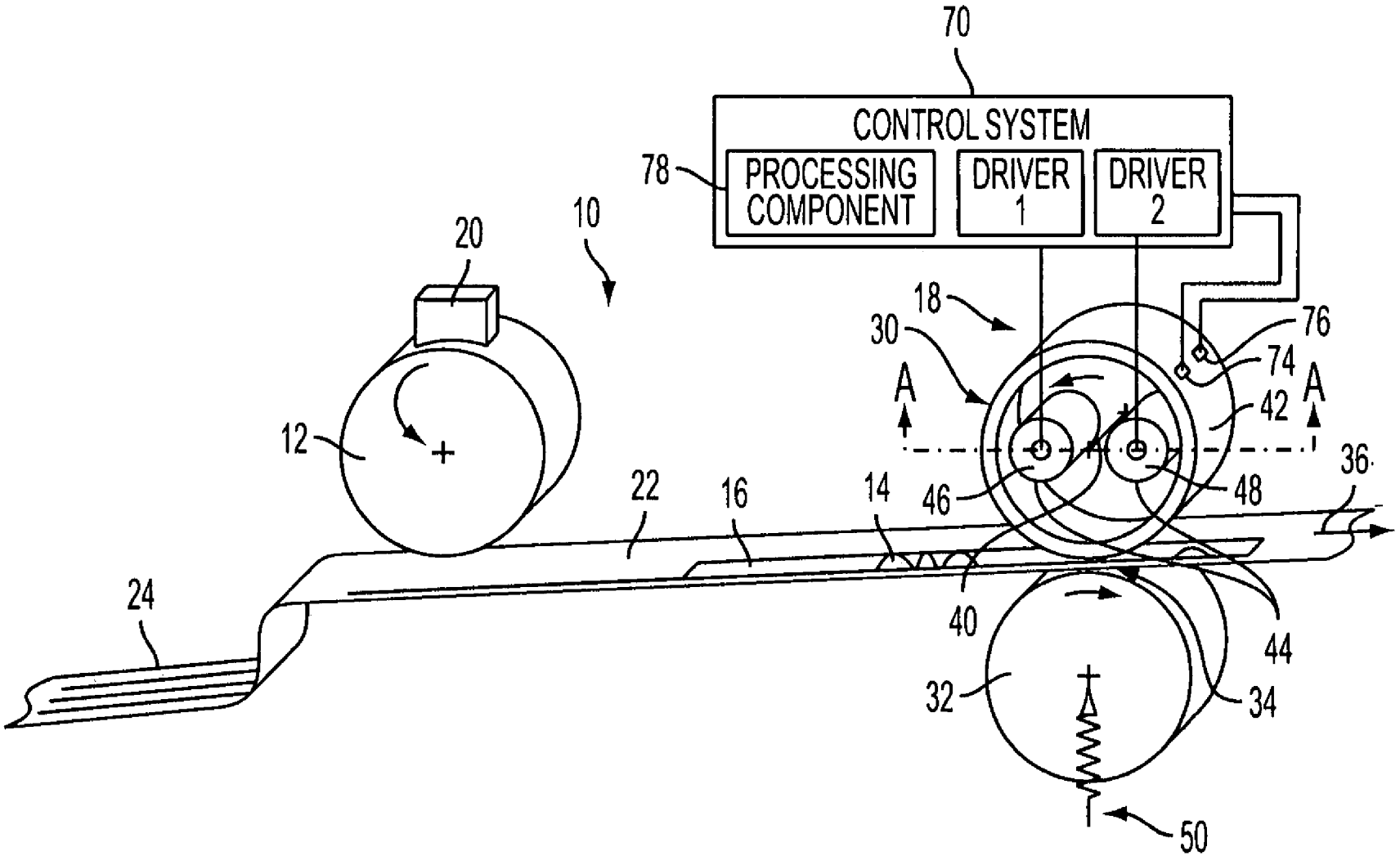
FIG. 1 is a perspective view of a printing system according to the exemplary embodiment.

With reference to FIG. 1, an electrophotographic printing system 10 includes an image applying component 12 which applies a toner image 14 to print media 16, such as paper, by the xerographic steps of latent image formation, development, and transfer, and a fusing apparatus 18 which fuses the applied image to the print media. The image applying component 12 includes one or more sources 20 of dry marking material, such as one or more of cyan, magenta, yellow and black (C, M, Y, K) powdered toners. A conveyor system 22 conveys the print media 16 from a source 24 of the print media to the image applying component 12 and conveys the print media with the applied image 14 thereon to the fusing apparatus 18. The exemplary printing system 10 may include a variety of other components, such as finishers, paper feeders, and the like, and may be embodied as a copier, printer, bookmaking machine, facsimile machine, or a multifunction machine. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. The operation of applying images to print media, for example, graphics, text, photographs, etc., is generally referred to herein as printing or marking.

The fusing apparatus 18 (or simply "fuser") generally includes a fuser roll 30 and a pressure roll 32, which are rotatably mounted in a fuser housing (not shown) and are parallel to and in contact with each other to form a nip 34 through which the print media 16 with the toner image thereon is passed, as indicated by arrow 36. The fuser roll 30 can comprise a rigid heat conducting cylindrical member with a longitudinal axis 40 which is aligned generally perpendicular to the process direction 36. The fuser roll 30 may be formed from aluminum, steel, or other suitable metal. The fuser roll 30 is hollow and generally has a wall thickness of about 5 mm, or less. The pressure roll 32 may be a cylindrical conformable roll which includes a metal core, such as steel, with a layer of silicone rubber or other conformable material on its outer surface that is covered by a conductive heat resistant material, such as, Teflon™.

Figure 2:
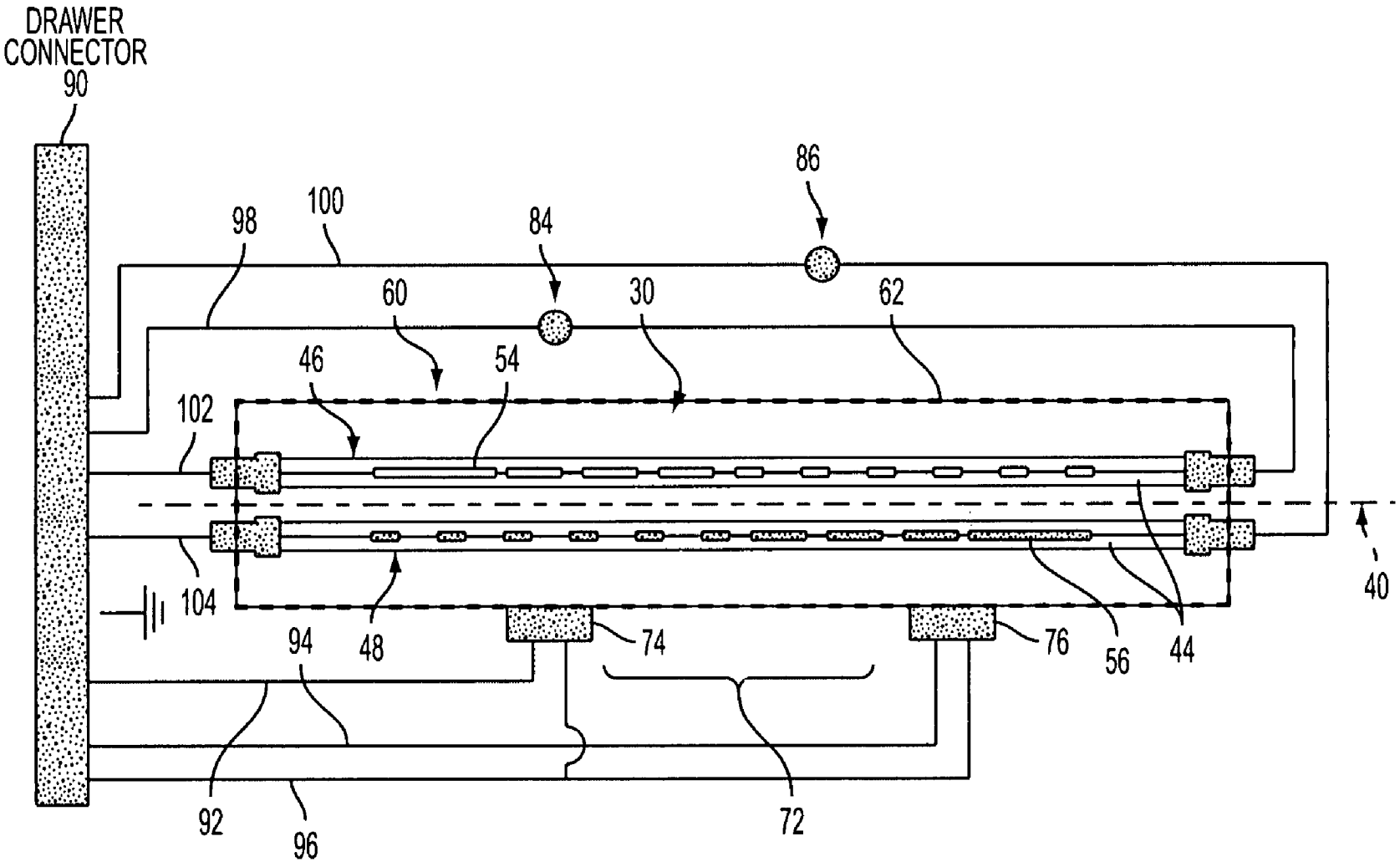
FIG. 2 is a schematic top plan view of the fusing apparatus of FIG. 1 through A-A.

A surface 42 of the fuser roll 30 is heated by a heating system 44 disposed within the fuser roll 30. As illustrated in FIG. 2, the heating system 44 includes a plurality of heating elements 46, 48 (two in the illustrated embodiment) disposed along the axial length of the fuser roll 30. The heating elements are aligned parallel to each other and parallel to the axis 40 of the fuser roll, and as such are disposed to be largely perpendicular to the direction of passage of the sheets passing through the nip 34 of the fusing apparatus. A drive system (not shown) rotates the fuser roll 30 and pressure roll 32 in the directions shown in FIG. 1. The pressure roll 32 is urged into contact with the fuser roll by a constant spring force, indicated by arrow 50. As the paper 16 with the toner image 14 is passed through the nip 34, the toner image melts and is permanently fused to the paper 16.

With reference to FIG. 2, the heating elements 46, 48 are configured as lamps and each includes a heat producing material 54, 56, such as an electrically conductive filament, which generates heat when a current is passed through the material. As can be seen in FIG. 2, each lamp 46, 48 has a specific configuration of heat-producing material, such that the lamp preferentially heats a different portion of the fuser roll 30. In this particular case, lamp 46 has the majority of the heat producing material 54 concentrated adjacent a first portion, such as an end 60 of the fuser roll (the left side of the fuser roll 30 in FIG. 2) while lamp 48 has the majority of the heat producing material 56 concentrated adjacent a second portion, such as end 62 (the right side in FIG. 2), which is axially spaced from the first end 60, and may be contiguous thereto. Thus, when current is passed through the lamps, lamp 46 preferentially heats the first end 60 of the fuser roll 30, while lamp 48 preferentially heats the second end 62. The first and second heating elements 46, 48 are independently powered, i.e., power can be applied to either one or to both heating elements, or to neither heating element in a give time period.

In a practical embodiment, the heat-producing material substantially comprises tungsten, and is enclosed within an envelope formed from borosilicate glass. It will be apparent that, with the illustrated configuration of heating elements 46, 48, each lamp can be said to have a relatively hot and a relatively cold end. By this is meant that when electrical power is applied to either lamp, one end of the lamp will largely generate more heat than the other end of the lamp. In other words, the hot end reaches a higher temperature than the cold end, and the hot end releases more heat per area on the outer surface 42 of the fuser roll 30 than the cold end. The lamps 46, 48 are arranged such that the relatively hot end of lamp 46 is adjacent the relatively cold end of lamp 48, and vice versa. Lamps 46, 48 may have substantially identical configurations of heat-producing material, and may be oriented in opposite directions, as shown.

While the illustrated heating elements 46, 48 are restively heated, other heating elements are also contemplated, such as induction heated elements.

Besides the illustrated configuration of portions of heating elements within each lamp as shown, other techniques for establishing a relatively hot end and a relatively cold end of a heating element or lamp will be apparent. For example, there may be provided, within the fuser roll 30, a relatively high-resistance portion of a heating element, in series with a relatively low-resistance portion. Alternately, there may be provided additional heating elements, in parallel with a main set of heating elements within a lamp, achieving the effect of a relatively hot end and a relatively cold end.

In an alternative embodiment, one lamp 46 heats the fuser roll 30 generally uniformly along the length while the other lamp 48 preferentially heats the end 60 of the fuser roll 30. This is the end of the cylinder which contacts both the full width and the narrow pages and thus is less likely to become overheated than the other end 62.

Figure 3:
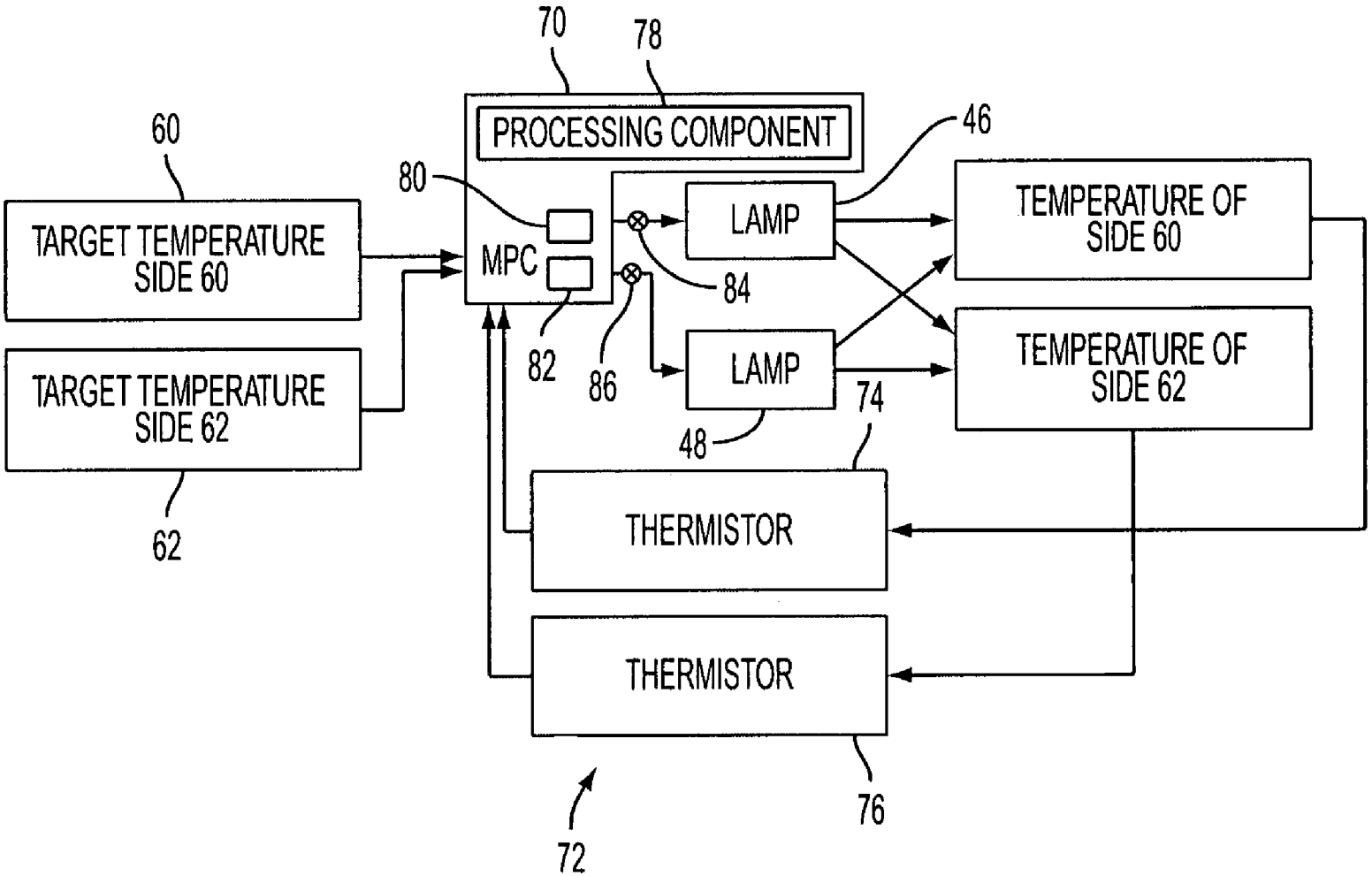
FIG. 3 is a schematic diagram showing the interactions between a control system and temperature sensors during temperature control of the fuser roll.

With reference also to FIG. 3, a control system 70 regulates the temperature of the fuser roll 30. The control system 70 takes into account the temperature of both ends 60, 62 of the fuser roll 30 in determining the power to be applied to the lamps 46, 48 in order to maintain the two ends 60, 62 of the fuser roll 30 within a desired operating temperature range. In particular, the control system may take into account a temperature differential between the monitored first or second temperature and a preselected temperature, such as a target operating temperature. The operating temperature range is selected so as to ensure adequate fusing of the toner particles while avoiding a high temperature which may cause damage to the fuser apparatus. In particular, the control system 70 makes use of a multivariate predictive control (MPC) method which considers the effect that the temperature of one side 60 of the fuser roll 30 will have on the other side 62 and determines appropriate power input to each heating element 46, 48 in accordance therewith.

A temperature sensing system 72 monitors the temperature of the fuser roll in at least two axially spaced locations. In the illustrated embodiment, temperature sensors 74, 76, such as thermistors, thermocouples, resistance temperature detectors, non-contact temperature-measuring devices such as infrared temperature-measuring devices, or other temperature detectors, monitor the local temperature of the surface 42 of the fuser roll. The thermistors 74, 76 are axially spaced along the fuser roll such that thermistor 74 monitors the temperature of portion 60 and thermistor 76 monitors the temperature of portion 62. For example, thermistors 74, 76 may be mounted symmetrically relative to a midpoint of the fuser roll 30, e.g., approximately midway between the midpoint and a respective end of the fuser roll 30, as shown in FIG. 2. As illustrated in FIG. 3, both thermistors 74, 76 provide inputs corresponding to sensed temperatures to the control system 70. The control system 70 includes a processing component 78, in the form of suitable software or hardware, which determines, based on both input temperatures, appropriate power inputs for the heating elements 46, 48. The processing component 78 may employ an algorithm which calculates the power to apply to the first and second heating elements based on the monitored temperatures. The algorithm may take into account other factors, such as the rate of change of the temperatures over time. Or, the algorithm may essentially ignore the temperature of the second side of the fuser roll in computing the power to supply to the first side until the temperature of the second side exceeds a preselected threshold temperature, such as 5 or 10° C. above the target temperature. The threshold temperature may be at or below the maximum operating temperature. At this point, the control system or reduces (e.g., shuts off) power to the first side until either the temperature of the second side falls below the threshold temperature or the first side drops to a threshold temperature at or slightly above the minimum operating temperature. It will be appreciated that in computing power supplies, the control system 70 may take into account predicted temperature changes as well as actual measured temperatures.

In another embodiment, the algorithm may be a simple two dimensional look up table which includes stored power supply values for each of a plurality of combinations of measured temperatures.

The control system 70 includes drivers 80, 82, which shut off power to the heaters, e.g., by control of thermal cutouts, such as switches 84, 86. The power applied to lamp 46 is a function of both thermistor readings and target temperatures of both sides 60, 62 of the fuser roll. Similarly, the power applied to lamp 48 is a function of both thermistor readings and target temperatures of both sides 60, 62 of the fuser roll. It will be appreciated that the target temperature and maximum and minimum operating temperatures may be the same for both sides of the roll.

The control system 70 may respond to a rise in temperature of one side 62 by shutting off power to the associated heating element 48. In some cases, such as when narrow paper is being fused, shutting off power to the heating element 48 may not be sufficient, of itself, to prevent the side 62 from exceeding a maximum acceptable temperature due to heat flowing from the other side 60 of the fuser roll 30. The control system 70, in such cases, applies less power to the side 60, such that the temperature of side 60 drops below the target temperature, but remains above a preselected minimum temperature. In this way, both sides of the fuser remain within the preselected operating temperature range.

The thermistors 74, 76 and lamps 46, 48 may be electrically connected to an earthed drawer connector 90, as illustrated in FIG. 2, which, in turn, is connected with a source of electric power (not shown) such as an AC source. Thermistors 74, 76 may have separate input leads 92, 94, and share a return lead 96. The lamps 46, 48 may have separate input and return leads 98, 100, 102, 104, respectively. Switches 84, 86 in input or return leads 98, 100, 102, 104 are operated by respective drivers 80, 82 and serve as thermal cutouts. In one embodiment, rather than simply on or off, power may be supplied incrementally to the lamps, variable between no power and full power.

Figure 4:
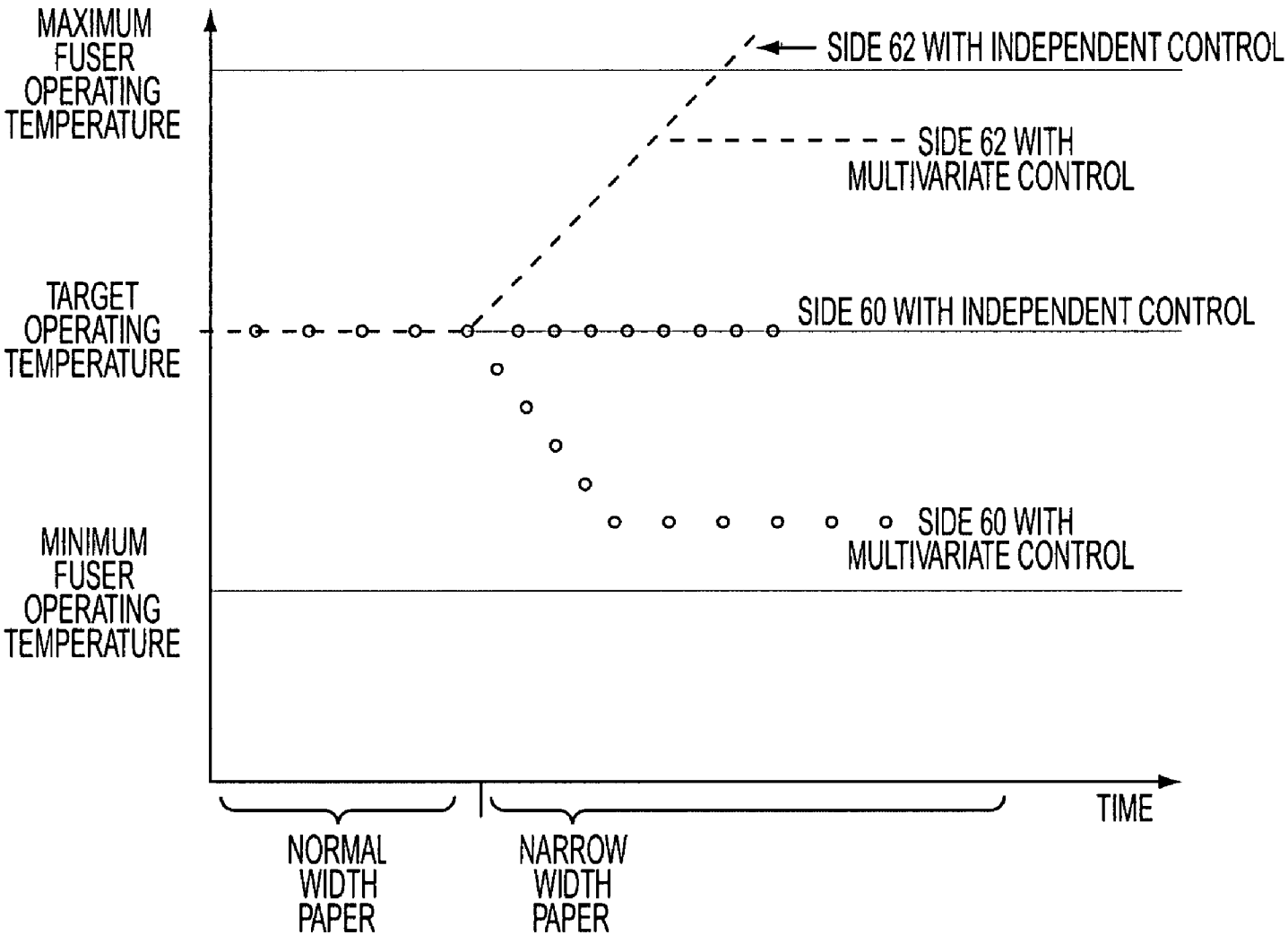
FIG. 4 is a simulated plot of temperature changes at a fuser roll surface when the fuser roll changes from fusing full width paper to fusing narrow width paper.

The benefits of the multivariate control system 70 are illustrated schematically in FIG. 4, which compares temperature changes in a comparative fuser assembly, in which each heating element is independently controlled by a feedback loop (e.g., with Proportional-Integral-Derivative (PID) control), with temperature changes in a fuser assembly configured according to the exemplary embodiment, in which multivariate control is applied. While the fuser assembly is fusing full width paper, the temperatures of the two sides 60, 62 of the fuser roll 30 can be controlled by intermittently switching on and off power to the heating elements. Both sides 60, 62 of the fuser may be maintained at approximately the same temperature, which is at or close to the target fusing temperature, during normal paper printing using both multivariate and independent control methods. The target temperature is intermediate a preselected maximum fuser operating temperature and a preselected minimum fuser operating temperature. For example, the target fusing temperature may be about 180° C. within the nip 34. Depending on the construction of the fuser and the toner being fused, the preselected maximum operating temperature may be about 220-230° C. Depending on the type of toner, the preselected minimum operating temperature may be about 170-175° C. When a series of narrow sheets are in the process of being fused, the temperature of one end of the fuser where there is no paper to take away heat, e.g., end 62, has a tendency to rise, as shown. In an independently controlled system, where both heating elements are independently controlled based on the corresponding thermistor readings, the temperature of side 62 tends to increase, due to heat flowing from the other side 60, even though the heating element 48 may be switched off. Side 60 meanwhile, is maintained at approximately the target temperature by selective application of power to the heating element 46. Eventually, if sufficient narrow sheets are fused, the temperature of side 62 reaches the preselected maximum operating temperature. At this point, the fuser of the comparative system shuts down and the printing system as a whole ceases printing.

With multivariate predictive control, however, the control system 70 of the exemplary embodiment recognizes when the disparity between the two sensed temperatures suggests that the temperature of side 62 cannot be corrected solely by shutting off power to the heating element 48. In such cases, the control system 70 also selectively controls power to the heating element 46. This causes the temperature of side 60 to drop below the target temperature. The control system may allow the temperature of the cooler side 60 to drop as low as the preselected minimum operating temperature, if needed, in order to maintain the hotter side 62 at a temperature which is below the preselected maximum operating temperature. Thus, the temperature of the side 60 may be allowed to drop up to about 10° C., or more, below the target temperature in order to maintain side 62 within the desired operating range. In general, the temperature of side 60 may be allowed to drop at least 5° C. below the target operating temperature.

The functions by which the multivariate predictive control processor 78 determines the power requirements for each lamp may be based on empirical data or derived by modeling. For example, the multivariate predictive control system 70 may determine power applied to each heater as a function of the temperature of each side and one or more of: the target operating temperature of each side, the preselected maximum operating temperature, and the preselected minimum operating temperature.

It will be appreciated that while the function used to determine a first amount of power to supply to the first heating element and the function used to determine a second, sometimes different, amount of power to the second heating element both take into account the temperatures monitored in the first and second thermistor locations, the functions are not the same and do not place the same weight on the two monitored temperatures. In general, the function for determining the amount of power to supply to heating element 46 places a greater weight on the temperature provided by thermistor 74 than it does on the temperature measured by thermistor 76. Similarly, the function for determining the amount of power to supply heating element 48 places a greater weight on the temperature provided by thermistor 76 than it does on the temperature measured by thermistor 74.

It is to be appreciated that even with multivariate predictive control, there may be some types of paper or situations where large numbers of sheets are to be printed in which the control system 70 cannot prevent the side 62 from overheating without shutting the fuser down. However, the occasions when this may occur are substantially less frequent than where an independent control system is employed.

The fuser apparatus 30 is suitable for fusing sheets of a wide range of sizes from sheets of a size comparable to the entire length of the fuser roll to relatively small, such as postcard-size, sheets. Although the smaller sheets can all be fed through the fusing apparatus toward the same end of the fuser roll, it is not necessary to do so because the control system can compensate for temperature fluctuations at either end of the fuser roll.

While the fuser apparatus has been described in terms of two heating elements 46, 48, it is to be appreciated that more than two heating elements may be employed for heating different portions of the fuser roll. For example, in a system with three heating elements, two may preferentially heat ends while a third heats the middle of the fuser roll.

Additionally more than two axially spaced thermistors may be provided, the control system 70 taking into account at least two of the thermistors in determining the power to supply to each heating element, which need not be the same two thermistors for each heating element.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fusing apparatus comprising:

a fuser roll and a pressure roll which define a nip therebetween;

two heating elements for heating the fuser roll, a first of the heating elements configured for heating a first portion of the fuser roll and a second of the heating elements configured for heating a second portion of the fuser roll, axially spaced from the first portion;

a temperature sensing system which monitors a first temperature of the first portion of the fuser roll and monitors a second temperature of the second portion of the fuser roll; and a control system which determines an amount of power to supply to the first heating element based on the first and second monitored temperatures and determines an amount of power to supply to the second heating element based on the first and second monitored temperatures.

2. The fusing apparatus of claim 1, wherein the first heating element preferentially heats the first portion of the fuser roll.

3. The fusing apparatus of claim 2, wherein the second heating element preferentially heats the second portion of the fuser roll.

4. The fusing apparatus of claim 1, wherein the first and second portions are contiguous.

5. The fusing apparatus of claim 1, wherein:

the amount of power supplied to the first heating element is influenced to a greater extent by the first temperature than by the second temperature; and the amount of power supplied to the second heating element is influenced to a greater extent by the second temperature than by the first temperature.

6. The fusing apparatus of claim 1, wherein the temperature sensing system includes a first temperature sensor which monitors a temperature of the first portion of the fuser roll and a second temperature sensor which monitors a temperature of the second portion of the fuser roll.

7. The fusing apparatus of claim 6, wherein the temperature sensors comprise first and second thermistors.

8. The fusing apparatus of claim 1, wherein each of the heating elements comprises a relatively hot portion and a relatively cold portion.

9. The fusing system of claim 8, wherein the relatively hot portion of the first heating element is axially aligned with the relatively cold portion of the second heating element.

10. The fusing apparatus of claim 1, wherein the control system allows the first monitored temperature to drop below a target operating temperature such that the second monitored temperature does not exceed a preselected maximum operating temperature which is above the target operating temperature.

11. The fusing apparatus of claim 1, wherein the heating elements comprise heat lamps.

12. The fusing apparatus of claim 1, wherein the first and second heating elements are aligned generally parallel with an axis of the fuser roll.

13. The fusing apparatus of claim 1, wherein the control system includes a look up table which includes a plurality of first temperatures and a plurality of second temperatures and corresponding power supplies to be applied to the first and second portions.

14. A printing system comprising an image applying component and the fusing apparatus of claim 1.

15. The printing system of claim 14, wherein the image applying component comprises a xerographic image applying component.

16. A method comprising:

providing a fuser roll having first and second heating elements;

monitoring a temperature of a first portion of the fuser roll;

monitoring a temperature of a second portion of the fuser roll which is axially spaced from the first portion;

supplying a first amount of power to the first heating element, the first amount of power being a function of the monitored temperatures of the first and second portions, the first heating element preferentially heating the first portion; and supplying a second amount of power to the second heating element, the second amount of power being a function of the monitored temperatures of the first and second portions, the second heating element preferentially heating the second portion.

17. The method of claim 16, wherein when the temperature of the second portion of the fuser roll rises to a first preselected temperature, reducing power to the first heating element until at least one of:

the temperature of the second portion falls below the first preselected temperature; and the temperature of the first portion falls to a second preselected temperature.

18. The method of claim 16, wherein the first portion is axially spaced from the second portion of the fuser roll.

19. The method of claim 16, wherein the function of the monitored temperatures at the first and second axially spaced locations used to determine an amount of power to supply to the first heating element places a greater weight on the monitored temperature at the first location than on the monitored temperature at the second location; and the function of the monitored temperatures at the first and second axially spaced locations used to determine an amount of power to supply to the second heating element places a greater weight on the monitored temperature at the second location than on the monitored temperature at the first location.

20. A fusing apparatus comprising:

a fuser roll;

a first heating element which heats a first portion of the fuser roll more than a second portion of the fuser roll;

a second heating element which heats the second portion of the fuser roll more than the first portion of the fuser roll;

a first temperature sensor which monitors a temperature of the first portion of the fuser roll;

a second temperature sensor which monitors a temperature of the second portion of the fuser roll; and a control system which determines a first amount of power to supply to the first heating element for heating the fuser roll, the first amount of power being a first function of the monitored temperatures of the first and second portions, and determines a second amount of power to supply to the second heating element for heating the fuser roll, the second amount of power being a second function of the monitored temperatures of the first and second portions, wherein the first function weights the monitored temperature of the first portion more than the monitored temperature of the second portion and the second function weights the monitored temperature of the second portion more than the monitored temperature of the first portion.

21. A method of fusing print media of different widths, comprising:

monitoring a temperature of a first portion of a fuser roll which contacts a first print media having a first width during fusing of the first print media and contacts a second print media having a second width less than the first width during fusing of the second print media;

monitoring a temperature of a second portion of the fuser roll which contacts the first print media having the first width during fusing of the first print media but does not contact the second print media having the second width during fusing of the second print media;

determining an amount of power to supply to a first heating element which heats the first portion and an amount of power to supply to a second heating element which heats the second portion such that when the first portion contacts the print media having the second width, the amount of power supplied to the first heating element takes into account the monitored temperature of the second portion such that the second portion is inhibited from exceeding a preselected maximum operating temperature.

* * * * *